US006705487B2

(12) United States Patent
Kim

(10) Patent No.: US 6,705,487 B2
(45) Date of Patent: Mar. 16, 2004

(54) ASSISTANCE TRAY FOR MANUAL DISTRIBUTION USED IN MEDICINE SHARING AND PACKING DEVICE

(75) Inventor: June Ho Kim, Daegu (KR)

(73) Assignee: JV Medi Co., Ltd., Daegu (KR)

( * ) Notice: Subject to any disclaimer, the term of this patent is extended or adjusted under 35 U.S.C. 154(b) by 235 days.

(21) Appl. No.: 09/964,350

(22) Filed: Sep. 28, 2001

(65) Prior Publication Data

US 2003/0019881 A1 Jan. 30, 2003

(30) Foreign Application Priority Data

Jul. 28, 2001 (KR) ..... 2001-22947 U

(51) Int. Cl.[7] ..... B65G 65/30

(52) U.S. Cl. ..... 221/312 B; 221/281; 222/485; 141/247; 220/625; 414/404

(58) Field of Search ..... 221/312 B, 281, 221/76, 82, 87, 89, 91; 414/403, 404; 206/538, 539; 53/473; 222/485; 141/247; 220/625

(56) References Cited

U.S. PATENT DOCUMENTS

| | | | | | |
|---|---|---|---|---|---|
| 169,935 | A | * | 11/1875 | Whitman | 222/131 |
| 350,675 | A | * | 10/1886 | Hathaway | 222/485 |
| 488,721 | A | * | 12/1892 | Stempel | 222/185.1 |
| 1,270,756 | A | * | 6/1918 | Holmberg | 414/404 |
| 3,227,127 | A | * | 1/1966 | Gayle | 116/308 |
| 3,481,103 | A | * | 12/1969 | Summerour | 53/473 |
| 3,562,475 | A | * | 2/1971 | Angelotti et al. | 219/744 |
| 3,604,559 | A | * | 9/1971 | McCall et al. | 206/533 |
| 3,820,655 | A | * | 6/1974 | La Tourette et al. | 206/532 |
| 3,990,209 | A | * | 11/1976 | Eisenberg | 53/437 |
| 4,572,376 | A | * | 2/1986 | Wrennall | 206/538 |
| 4,771,912 | A | * | 9/1988 | van Wingerden | 221/75 |
| 4,811,764 | A | * | 3/1989 | McLaughlin | 141/98 |
| 5,381,904 | A | * | 1/1995 | Thurell | 206/538 |
| 5,383,559 | A | * | 1/1995 | Toren | 206/533 |
| 5,522,525 | A | * | 6/1996 | McLaughlin et al. | 221/4 |
| 5,588,792 | A | * | 12/1996 | Tiso | 414/404 |
| 5,797,248 | A | * | 8/1998 | Hetherington et al. | 53/473 |
| 6,023,916 | A | * | 2/2000 | Bouthiette | 53/471 |
| 6,050,064 | A | * | 4/2000 | Yuyama et al. | 53/514 |
| 6,109,486 | A | * | 8/2000 | Lee et al. | 222/485 |
| 6,119,440 | A | * | 9/2000 | Benner, Jr. et al. | 53/473 |
| 6,449,921 | B1 | * | 9/2002 | Kim | 53/154 |
| 6,457,611 | B1 | * | 10/2002 | Koehler | 222/462 |
| 6,508,279 | B2 | * | 1/2003 | Siegel et al. | 141/2 |
| 6,581,356 | B2 | * | 6/2003 | Kim | 53/154 |

FOREIGN PATENT DOCUMENTS

| | | | | |
|---|---|---|---|---|
| GB | 2178397 | * | 2/1987 | 414/404 |

* cited by examiner

*Primary Examiner*—Donald P. Walsh
*Assistant Examiner*—Daniel K Schlak
(74) *Attorney, Agent, or Firm*—Jacobson Holman PLLC

(57) ABSTRACT

An assistance tray for manual distribution used in a medicine sharing and packing device with a disk-type tray for manual distribution of pills mounted in the front side. The assistance tray includes an assistance tray body at the rim portion of which a plurality of auxiliary pill containing portions are formed which correspond in number to a plurality of pill containing portions formed at the rim of the upper surface of a disk-type tray for manual distribution, and on both sides of which handle portions are formed having openings therethrough. An opening/closing plate is mounted on the lower surface of the assistance tray body so as to be rotated, at the rim portion of which holes are formed, a number of the holes corresponding in number to the number of the auxiliary pill containing portions of the assistance tray body. On one side of the opening/closing plate a protruding control handle portion is formed, movement of which opens the bottom of the auxiliary pill containing portions of the assistance tray body and accordingly enables pills distributed to each auxiliary pill containing portion of the assistance tray body to be fed into the pill containing portions of the disk-type tray for manual distribution at the same time.

7 Claims, 5 Drawing Sheets

ASSISTANCE TRAY FOR MANUAL DISTRIBUTION USED IN MEDICINE SHARING AND PACKING DEVICE

BACKGROUND OF THE INVENTION

The present invention relates to an assistance tray for manual distribution which is used in a medicine sharing and packing device designed to automatically pack pills contained in a plurality of tablet cassettes automatically controlled and ones manually distributed to a disk-type tray for manual distribution dose by dose, and more particularly, an assistance tray for manual distribution which is designed to exactly distribute pills manually distributed, facilitate seeing the distributed pills, and quickly supply them to a medicine sharing and packing device.

In general, many kinds of pills are used to treat various diseases, and a plurality of different pills are prescribed mixedly due to complexity of a disease. As the development of technology will bring about the development of more medicines in the future, in addition to tablet cassettes mounted in a limited space disk-type trays for manual distribution are needed.

For conventional medicine sharing and packing devices, a plurality of tablet cassettes containing various pills are arranged, and medicine is packed dose by dose through control of the table cassettes. Since there are difficulties in containing more kinds of medicines being developed continuously into tablets cassettes, rearranging the cassettes, and supplying and packing pills prescribed to use half of each pill, a tray for manual distribution is additionally mounted on a medicine sharing and packing device.

A conventional tray for manual distribution is of disk type with a plurality of spaces for containing pills on the rim portion of its upper surface, in which half of a pill or pills which cannot be contained in tablet cassettes and are difficult to supply and pack automatically are distributed manually.

Once a pharmacist distributes pills, which are to be supplied manually out of prescribed ones, to a tray for manual distribution, and sees pills distributed to the tray, pills contained in tablet cassettes and ones distributed to the tray are supplied and packed together dose by dose by actuating the medicine sharing and packing device.

However, there is a disadvantage that for a conventional tray for manual distribution, packing remains stopped while pills are distributed to the tray and it takes much time to distribute and pack pills according to prescription, since pills are supplied from the tablet cassettes and tray after they are distributed manually to the tray.

Therefore, a doctor or pharmacist can reduce the whole packing time by continuously performing control of tablet cassettes and packing work while continuously distributing pills to the tray manually.

However, there is another disadvantage that since pills may be distributed incorrectly when a doctor or pharmacist continuously distributes pills to the tray, wrong packing of pills may occur.

SUMMARY OF THE INVENTION

The present invention is contrived to overcome the conventional disadvantages described above. Therefore, it is an object of the present invention to provide an assistance tray for manual distribution which is designed to exactly distribute pills manually distributed, facilitate seeing the distributed pills, and quickly supply them to a medicine sharing and packing device.

To achieve the above-described object, an assistance tray for manual distribution used in a medicine sharing and packing device with a disk-type tray for manual distribution of pills mounted in the front side is provided. The assistance tray includes an assistance tray body at the rim portion of which a plurality of auxiliary pill containing portions are formed which correspond in number to a plurality of pill containing portions formed at the rim of the upper surface of a disk-type tray for manual distribution, and on both sides of which handle portions are formed having openings therethrough. An opening/closing plate is mounted on the lower surface of the assistance tray body so as to be rotated, at the rim portion of which holes are formed, a number of the holes corresponding in number to the number of the auxiliary pill containing portions of the assistance tray body. On one side of the opening/closing plate a protruding control handle portion is formed, movement of which opens the bottom of the auxiliary pill containing portions of the assistance tray body and accordingly enables pills distributed to each auxiliary pill containing portion of the assistance tray body to be fed into the pill containing portions of the disk-type tray for manual distribution at the same time.

DETAILED DESCRIPTION OF THE PREFERRED EMBODIMENTS

With reference to the accompanying drawings, the present invention will now be described.

Figure 1:
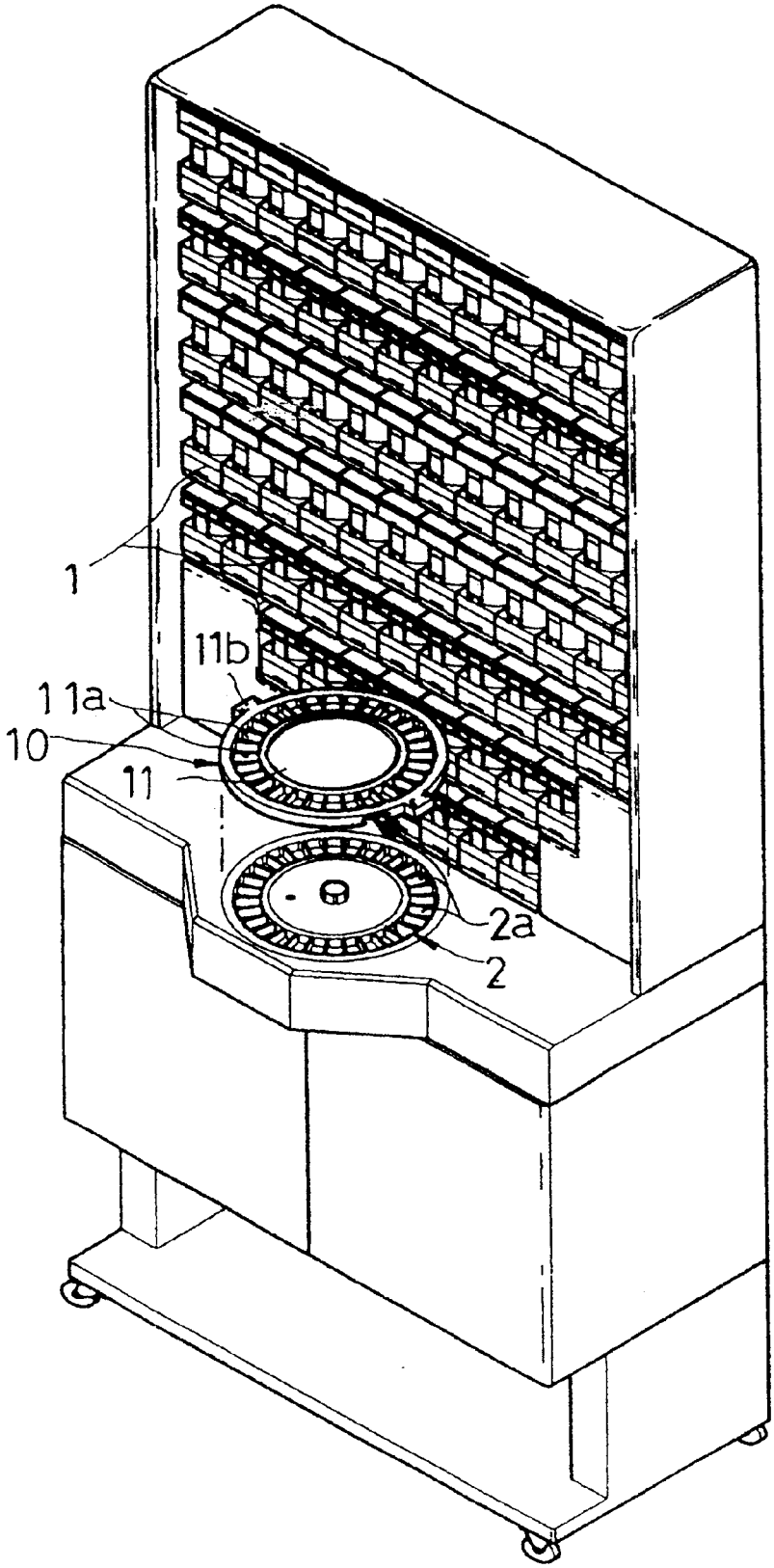
FIG. 1 is a perspective view showing a medicine sharing and packing device to which an assistance tray for manual distribution according to the present invention applies.
Figure 2:
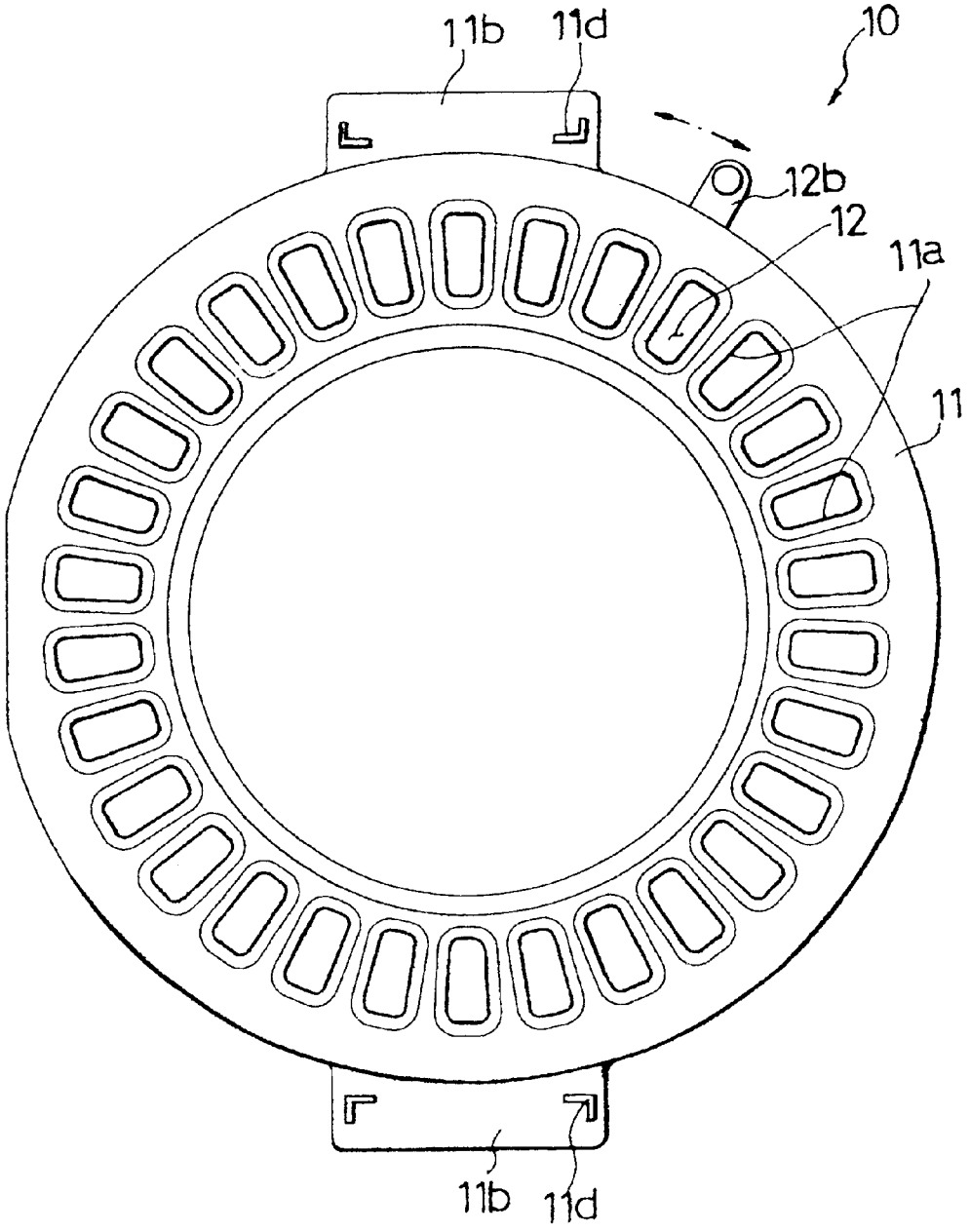
FIG. 2 is a plan view of an assistance tray for manual distribution used in medicine sharing and packing device according to the present invention.
Figure 3:
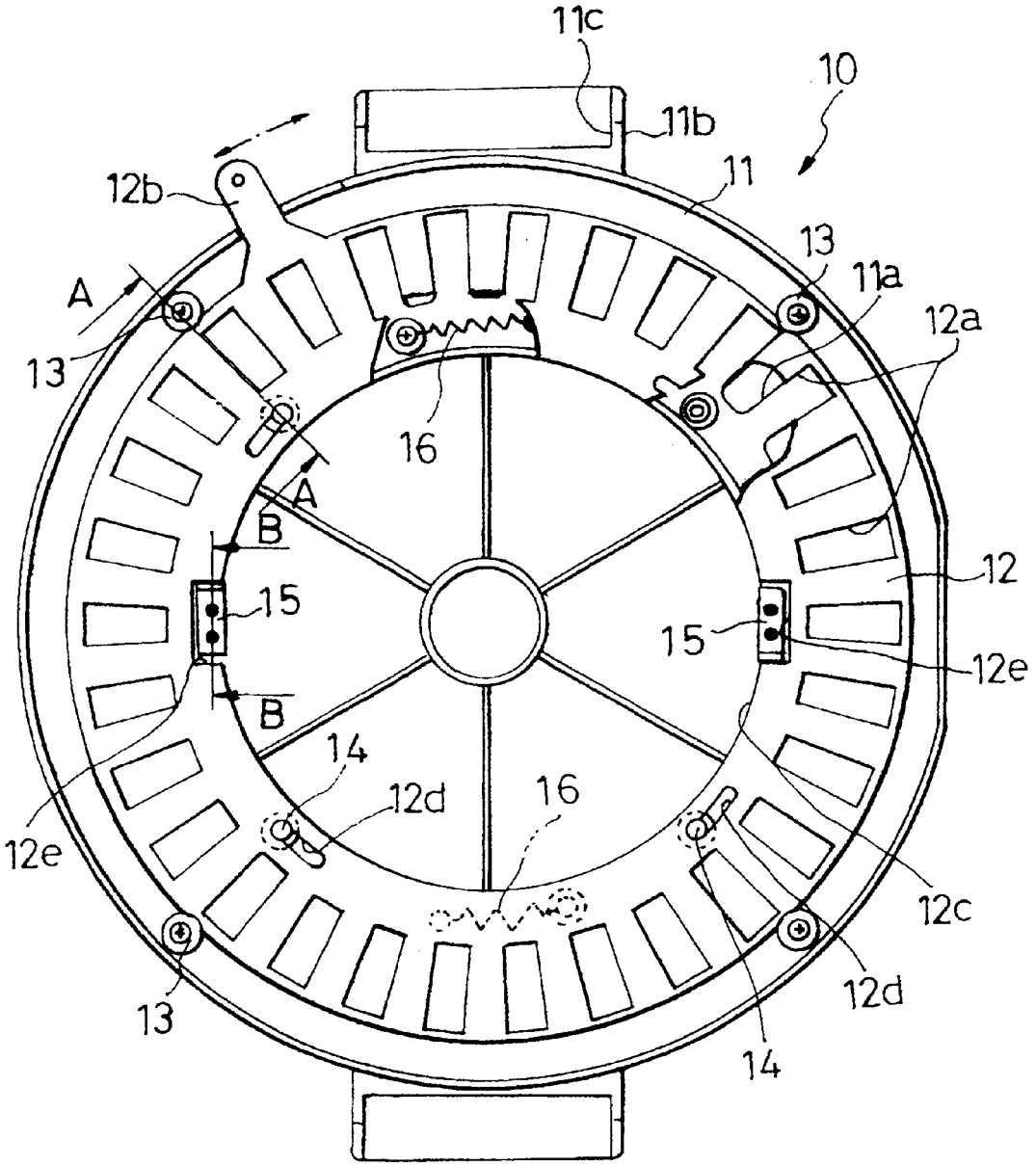
FIG. 3 is a bottom view of an assistance tray for manual distribution used in medicine sharing and packing device according to the present invention.
Figure 4:
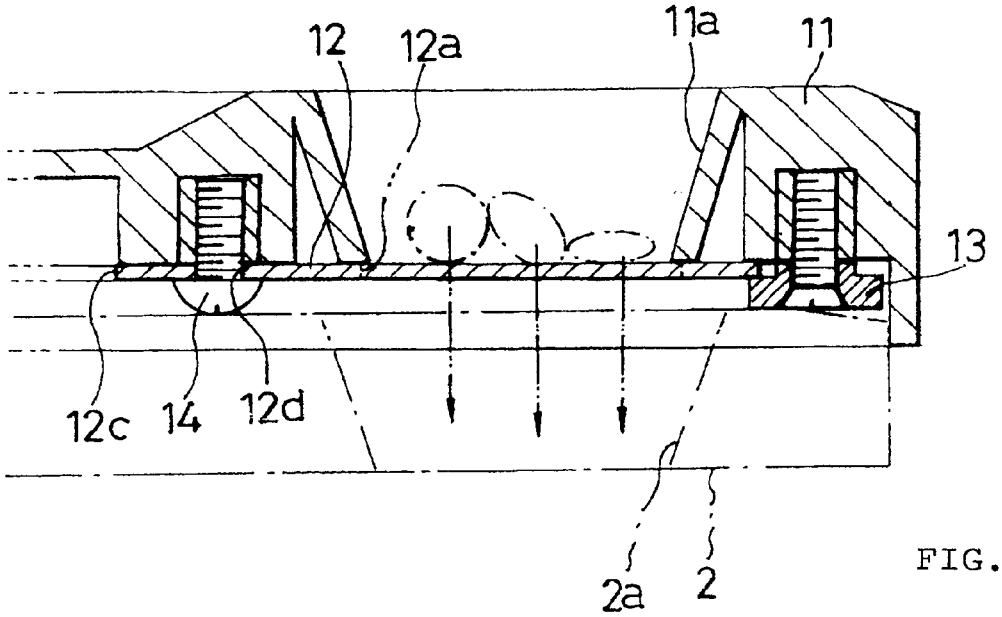
FIG. 4 is a cross-sectional view taken along line A—A of FIG. 3.
Figure 5:
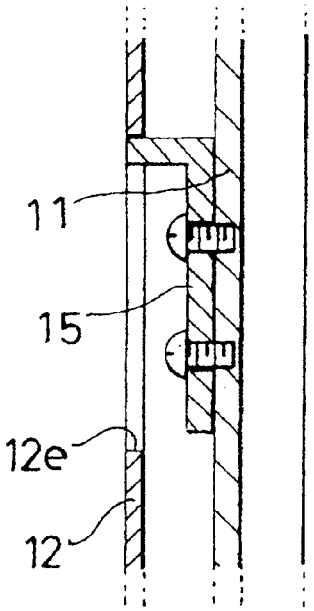
FIG. 5 is a cross-sectional view taken along line B—B of FIG. 3.

FIG. 1 shows a medicine sharing and packing device to which an assistance tray for manual distribution according to the present invention applies. The medicine sharing and packing device, like conventional ones, is designed to arrange a plurality of tablet cassettes(1) containing pills and pack medicine dose by dose through control of the tablet cassettes 1. A disk-type tray 2 for manual distribution, which can manually distribute half of a pill or pills which cannot be contained in tablet cassettes 1 and therefore packed automatically, is mounted on the front side of the medicine sharing and packing device, thereby allowing pills contained in the tablet cassettes 1 and ones contained in the tray 2 for manual distribution to be packed together dose by dose.

An assistance tray 10 according to the present invention, which is designed to put pills, which are distributed beforehand, into the tray 2 for manual distribution of the medicine sharing and packing device at a time, is so structured that, as illustrated in FIGS. 2, 3, 4 and 5, an opening/closing plate 12 is mounted on the lower surface of an assistance tray body 11 having a plurality of auxiliary pill containing portions so as to be rotated, thereby allowing the auxiliary pill containing portions of the assistance tray body 11 to be opened and closed by the opening and closing plate 12.

That is, the assistance tray body 11 has a plurality of the auxiliary pill containing portions 11*a* having openings therethrough at its rim portion corresponding in number to a plurality of pill containing portions 11*a* formed at the rim portion of the upper surface of the disk-type tray 2 for manual distribution, and handle portions 11*b* on both sides.

Figure 6:
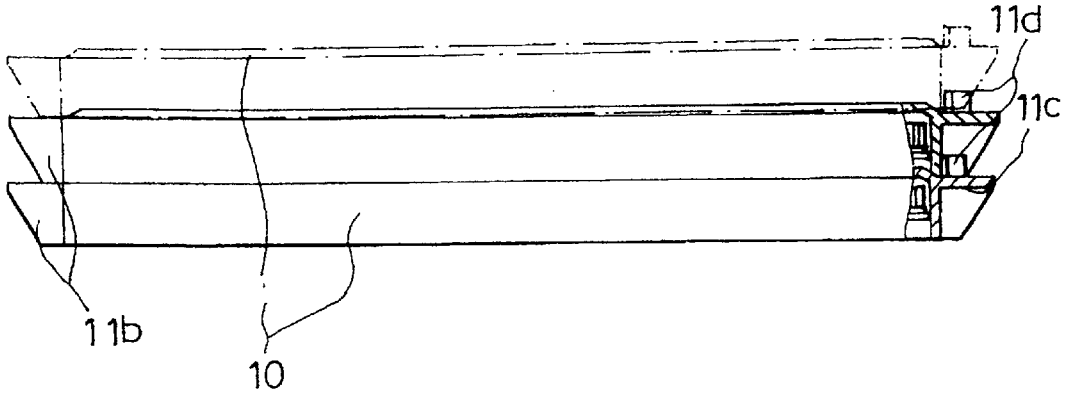
FIG. 6 is a view showing layered assistance trays for manual distribution used in medicine sharing and packing device according to the present invention.

Further, as illustrated in FIG. 6, two projections 11*d* are formed on both sides of the upper surface of the handle portions 11*b* of the assistance tray body 11, which fit onto grooves 11*c* formed on the lower parts of the handle portions 11*b*, thereby allowing a plurality of the assistance tray bodies to be placed in layers as well.

The opening/closing plate 12 is mounted on the lower surface of the assistance tray body 11 so as to be rotated, and has holes 12*a* at its rim portion corresponding in number to the auxiliary pill containing portions 11*a* of the assistance tray body 11 and a protruding control handle portion 12*b* on one side, thereby opening the bottom of the auxiliary pill containing portions 11*a* of the assistance tray body 11 and accordingly enabling pills distributed to each auxiliary pill containing portion 11*a* of the assistance tray body 11 to be fed into the pill containing portions 2*a* of the disk-type tray 2 for manual distribution at the same time.

On the other hand, it is desirable that to facilitate the rotation of the opening/closing plate 12, a plurality of supporting rollers 13, which support the circumferential surface of the opening/closing plate 12, be mounted in the spaced state at the rim portion of the assistance tray body 11, an inside diameter portion 12*c* be formed at the central portion of the opening/closing plate 12, a plurality of circular slots 12*d* be formed in the spaced state near the inside diameter portion 12*c*, and screws 14 be inserted into the slots 12*d* for fastening to the assistance tray body 11.

Further it is desirable that stoppers 15 for stopping the opening/closing plate 12 at a specific rotary angle by supporting one side of two grooves 12*e* formed at the inside diameter portion 12*c* of the opening/closing plate 12 be fixed to the assistance tray body 11, in order to maintain a uniform rotary angle of the opening/closing plate 12.

To return the opening/closing plate 12 to its initial state, two elastic members 16 for rotating the opening/closing plate 12 in the direction of closing the auxiliary pill containing portions 12 of the assistance tray body 11 are connected between the assistance tray body 11 and the opening/closing plate 12.

An assistance tray for manual distribution used in a medicine sharing and packing device according to the present invention works as follows.

If pills not contained in tablet cassettes 1 or half-pills are prescribed, a pharmacist distributes them manually to auxiliary pill containing portions 11*a* of an assistance tray body 11 of an assistance tray 10.

Then, the pharmacist matches the assistance tray body 11 with a tray 2 for manual distribution by gripping and lifting handles 11*b* of the assistance tray body 11, and rotates an opening/closing plate 12 by means of a control handle portion 12*b* to match holes 12*a* of the opening/closing plate 12 with the auxiliary pill containing portions 11*a* of the assistance tray body 11.

Then, pills contained in the auxiliary pill containing portions 11*a* of the assistance tray body 11 are dropped into pill containing portions 2*a* of the tray 1, and the opening/closing plate 12 is returned to the initial state by elastic members 16 and closes the auxiliary pill containing portions 11*a* of the assistance tray body 11 by releasing the control handle portion 12*b* of the opening/closing plate 12.

After the assistance tray 10 is spaced from the tray 1, pills in the pill containing portions 2*a* of the tray are packed dose by dose with pills dropped from tablet cassettes 1 by the operation of the medicine sharing and packing device.

Of course, it is desirable that a plurality of assistance trays 10 be used, thereby facilitating exact check of pills distributed in advance according to prescription and quick standby of the assistance tray 10 before pills distributed to the tray 2 are packed, so that quick packing can be realized.

As illustrated in FIG. 6, it is possible to distribute pills another assistance tray 10 after distributing them into one assistance tray 10, and to place many assistance trays 10, to which pills are distributed, in layers.

Accordingly, if the assistance trays 10 in layers are used, pills distributed to the assistance trays 10 can be supplied more quickly than in the state of having been distributed to the tray 2.

As discussed above, an assistance tray for manual distribution allows pills distributed separately to be quickly supplied to a tray for manual distribution of a medicine sharing and packing device by means of a control handle of an opening/closing plate. Therefore, pills distributed manually can be distributed quickly and checked easily. The use of additional assistance trays enables pills distributed manually to be supplied quickly to a medicine sharing and packing device.

What is claimed is:

1. An assistance tray for manual distribution used in medicine sharing and packing device with a disk-type tray for manual distribution of pills mounted in the front side comprising:

an assistance tray body having a rim portion in which a plurality of auxiliary pill containing portions are formed, a number of said plurality of auxiliary pill containing portions generally corresponding to a number of a plurality of pill containing portions formed at a rim of an upper surface of the disk-type tray, and a handle portion having an opening therethrough; and an opening/closing plate which is mounted on a lower surface of said assistance tray body so as to be rotated, said opening/closing plate having a rim portion in which holes are formed, a number of said holes generally corresponding to the number of said auxiliary pill containing portions of said assistance tray body, and on one side of which plate a protruding control handle portion is formed, for rotation of said opening/closing plate to thereby open a bottom of said auxiliary pill containing portions of said assistance tray body and accordingly enable pills distributed to each auxiliary pill containing portion to be simultaneously fed into said pill containing portions of said disk-type tray for manual distribution.

2. The assistance tray for manual distribution used in medicine sharing and packing device according to claim 1, wherein a plurality of supporting rollers, which support a circumferential surface of said opening/closing plate, are mounted in a spaced state at the rim portion of said assistance tray body, an inside diameter portion is being formed at a central portion of said opening/closing plate, a plurality of circular slots being formed in a spaced state near said inside diameter portion, and screws to be inserted into said slots being fastened to said assistance tray body to support said opening/closing plate.

3. The assistance tray according to claim 2, further comprising stoppers for determining a rotary angle of said opening/closing plate by supporting one side of two grooves formed at said inside diameter portion of said opening/closing plate being fixed to said assistance tray body, and two elastic members for rotating said opening/closing plate in the direction of closing said auxiliary pill containing portions being connected between the assistance tray body and the opening/closing plate.

4. An assistance tray for manual distribution used in medicine sharing and packing device with a disk-type tray for manual distribution of pills mounted in the front side comprising:

an assistance tray body having a rim portion in which a plurality of auxiliary pill containing portions are formed, a number of said plurality of auxiliary pill containing portions generally corresponding to a number of a plurality of pill containing portions formed at a rim of an upper surface of the disk-type tray, and a handle portion having an opening therethrough; and an opening/closing plate which is mounted on a lower surface of said assistance tray body so as to be rotated, said opening/closing plate having a rim portion in which holes are formed, a number of said holes generally corresponding to the number of said auxiliary pill containing portions of said assistance tray body, rotation of said opening/closing plate opening a bottom of said auxiliary pill containing portions of said assistance tray body and accordingly enabling pills distributed to each auxiliary pill containing portion to be simultaneously fed into said pill containing portions of said disk-type tray for manual distribution, on one side of which plate a protruding control handle portion is formed for rotation of said opening/closing plate.

5. The assistance tray for manual distribution used in medicine sharing and packing device according to claim 4, wherein a plurality of supporting rollers, which support a circumferential surface of said opening/closing plate, are mounted in a spaced state at the rim portion of said assistance tray body, an inside diameter portion being formed at a central portion of said opening/closing plate, a plurality of circular slots being formed in a spaced state near said inside diameter portion, and screws to be inserted into said slots being fastened to said assistance tray body to support said opening/closing plate.

6. The assistance tray for manual distribution used in medicine sharing and packing device according to claim 5, further comprising stoppers for determining a rotary angle of said opening/closing plate by supporting one side of two grooves formed at said inside diameter portion of said opening/closing plate being fixed to said assistance tray body, and two elastic members for rotating said opening/closing plate in the direction of closing said auxiliary pill containing portions being connected between the assistance tray body and the opening/closing plate.

7. The assistance tray for manual distribution used in medicine sharing and packing device according to claim 4, wherein each side of said assistance tray body includes a handle portion having an opening therethrough.

* * * * *